US006701769B2

(12) United States Patent
Shiroza

(10) Patent No.: US 6,701,769 B2
(45) Date of Patent: Mar. 9, 2004

(54) TRANSFER FEEDER

(75) Inventor: Kazuhiko Shiroza, Komatsu (JP)

(73) Assignee: Komatsu Ltd. (JP)

( * ) Notice: Subject to any disclaimer, the term of this patent is extended or adjusted under 35 U.S.C. 154(b) by 0 days.

(21) Appl. No.: 10/114,979

(22) Filed: Apr. 4, 2002

(65) Prior Publication Data

US 2002/0144533 A1 Oct. 10, 2002

(30) Foreign Application Priority Data

Apr. 6, 2001 (JP) ..... 2001-108964

(51) Int. Cl.[7] ..... B21D 43/05
(52) U.S. Cl. ..... 72/405.1; 72/405.1; 198/621.1
(58) Field of Search ..... 72/405.1, 405.11, 72/405.16, 405.01; 198/621.1, 621.2

(56) References Cited

U.S. PATENT DOCUMENTS 5,159,827 A * 11/1992 Shiraishi et al. ..... 72/405.1
5,383,348 A 1/1995 Michael et al.
5,737,960 A * 4/1998 Brandstetter et al. .... 72/405.16
6,314,786 B1 * 11/2001 Hofele et al. ..... 72/405.11

FOREIGN PATENT DOCUMENTS

| | | |
|---|---|---|
| JP | 6-262280 | 9/1994 |
| JP | 6-312233 | 11/1994 |
| JP | 7-15622 | 4/1995 |
| JP | 03-047639 | 2/2001 |

* cited by examiner

*Primary Examiner*—Daniel C. Crane
(74) *Attorney, Agent, or Firm*—Rader, Fishman & Grauer PLLC

(57) ABSTRACT

Short lift beam is employed for each transfer area, the lift beam is driven by a compact servomotor for transferring the workpieces, and the carrier is driven by the linear motor being integral therewith. Therefore, consumption of electric power can be reduced significantly, thereby promoting energy saving. The control may be performed depending on the die employed in each workstation by controlling the motion of the lift beam or the carrier at each transfer area arbitrarily by the controller. Consequently, drive with interference between the workpieces and the dies eliminated can be realized irrespective of the size or other element of the dies, thereby increasing design freedom of the die.

24 Claims, 13 Drawing Sheets

TRANSFER FEEDER

BACKGROUND OF THE INVENTION

1. Field of the Invention

The present invention relates to a transfer feeder including a plurality of workstations to be used for a transfer press, and more specifically, to a transfer feeder to be used for a transfer press including a slide drive unit at each of the plurality of workstations.

2. Description of the Related Art

Hitherto, the transfer press provided with a plurality of workstations in the press body comprises a transfer feeder adapted to transfer a workpiece sequentially to each workstation.

Such a transfer feeder comprises a pair of parallel transfer bars disposed on both sides along the workpiece conveying direction, and each transfer bar is extending continuously through the entire length of all the workstations.

The workpiece machined at each workstation is held by workpiece holder provided between the pair of transfer bars, and conveyed to the next process while being lifted by the same amount. Therefore, the die height in the transfer press and the height of the conveying surface at the lower die are kept almost constant at each workstation for ensuring holding of the workpieces by the workpiece holder and preventing interference with the die at the time of carrying in and out each station.

The transfer bars may be driven by a main motor for slide driving via a complex link mechanism or a cam mechanism or, in recent years, driven by a specific servomotor provided separately from the main motor.

However, in the conventional transfer feeder, when driving the transfer bars by the main motor, loss of energy may be occurred at the link mechanism and the cam mechanism between the main motor and the transfer bars. In addition, since the transfer bars to be driven are long and large scaled, the main motor is obliged to be upsized. As a consequent, consumption of electric power increases, and thus it is economically disadvantageous.

Even in the case of employing a servomotor, in order to drive a long and large scaled transfer feeders reliably with a single servomotor, the upsized servomotor is necessary, whereby consumption of electric power increases and thus it is economically disadvantageous.

In addition, since various restrictions due to the movement of the transfer bars such that interference with the transfer bars must be eliminated through the processes for example are imposed on the die used in the transfer press, there are problems in that design freedom is low and much time and efforts are required for its design.

Accordingly, it is an object of the invention to provide a transfer feeder in which energy consumption at the driving mechanism can be saved, and the die for the transfer press can easily be designed.

SUMMARY OF THE INVENTION

Accordingly, the present invention is a transfer feeder to be used for a transfer press provided with a plurality of workstations comprising: a pair of parallel lift beams disposed along the workpiece conveying direction; another pair of lift beams disposed adjacent to the pair of lift beams on the upstream side or the downstream side as seen in the workpiece conveying direction so that the adjacent portion is located at the substantially center of the workstation in the workpiece conveying direction; lift driving mechanism for moving the pair of lift beams and another pair of lift beams independently in the vertical direction; a carrier provided for each lift beam; carrier driving mechanism provided with a linear motor for moving the carrier along the length of the lift beam; workpiece holder disposed between the pair of carriers opposed with each other in the direction orthogonal to the workpiece conveying direction and being capable of holding the workpiece and moving along with the pair of carriers; and controller for driving the pair of lift beams and of the carriers between the workstations respectively simultaneously and/or individually independently by controlling the lift driving mechanism and the carrier driving mechanism.

In the invention thus constructed, short lift beams each having a length as short as a transfer bar divided into several pieces instead of the conventional transfer bars extending continuously through all the workstations, and the lift beams and the carriers provided on the respective lift beams are driven by the individual lift driving mechanism and the carrier driving mechanism. Therefore, because the length of the lift beam is shorter than that of the conventional transfer beam, the lift driving mechanism can be downsized. As a consequent, even when energy consumption in the carrier driving mechanism is taken into account, consumption of energy in the entire system may be reduced significantly in comparison with the case in which the conventional large scaled transfer bar is driven by a large sized main motor, or a large sized servomotor for driving the slide, thereby promoting energy saving.

In addition, by controlling the lift driving mechanism and the carrier driving mechanism according to the die used, the lift beams and the carriers provided between the workstations are not affected by the size or the shape of the die, and thus can be driven without interference with the die. Therefore, in the transfer press, restrictions imposed on the die as is in the related art are alleviated and thus design freedom of the die increases.

In the invention, a slide drive unit is provided at each of the plurality of workstations, and the controller (3) can be adapted to drive the lift beams and the carriers in the sections between the workstations and the slides in the workstations simultaneously and/or individually independently by controlling the lift driving mechanism, the carrier driving mechanism, and the slide drive unit.

In the invention thus constructed, since the slide drive unit is provided for each workstation and the slide drive unit is controlled by the controller, in addition to the case of driving the slides at the respective workstation simultaneously without phase difference as in the case of the original transfer press, by driving them simultaneously under the different conditions, or by driving them individually and independently, the transfer press may have capabilities of the original transfer press, capabilities of the tandem press, and capabilities of a single press altogether, so that it can be adapted to various works.

In this invention, the adjacent portions between the pair of lift beams and another pair of lift beams are preferably provided at each workstation of the transfer press.

In the invention thus constructed, since it is possible to produce optimal feeding motion for each section between adjacent workstations, the freedom of die construction increases significantly, and thus manufacture of the die is further facilitated. In addition, since the section between adjacent workstations must simply be considered when producing feeding motion, acceleration generated at the lift beam can be restrained to the required minimum extent, and thus the transfer feeder can follow the high-speed motion of the press in cooperation with weight reduction of the lift beam itself.

Since the lift beams being significantly shorter than the conventional transfer bar are used in all the sections between the adjacent workstations, the lift driving mechanism can further be downsized. Since the length of the lift beam, the number of carriers used, and the size, the number, and the like of the driving mechanism may be the same for every workstation, the kinds of the member used are not increased, and thus manufacture is facilitated.

In the invention, it is preferable that the end portions of the pair of lift beams and the end portions of another pair of lift beams face toward each other in the workpiece conveying direction at the adjacent portions between the pair of lift beams and another pair of lift beams.

In the invention thus constructed, since the width space between the parallel lift beams increases by arranging the lift beams in parallel and in alignment with each other along the workpiece conveying direction as a whole, a sufficient space can be established between the lift beam and the die, which further facilitates designing of the die.

In the invention, it is preferable that the end portions of the pair of lift beams and the end portions of another pair of lift beams face toward each other in the direction orthogonal to the workpiece conveying direction in plan view at the adjacent portions between the pair of lift beams and another pair of lift beams.

The two lift beams being adjacent along the workpiece conveying direction have their adjacent portions in the vicinity of the centers of the workstations. In order to convey the workpieces with these lift beams, it is necessary to move the workpiece holder correctly to the centers of the workstations in the workpiece conveying direction. However, in the invention, since the adjacent portions of the lift beams are faced toward each other in the direction orthogonal to the workpiece conveying direction in plan view, the workpiece holder of the respective lift beams may be pulled into the centers of the workstations without inter-collision by moving the carriers of the respective lift beams alternately toward the adjacent portions, thereby achieving preferable conveyance of workpieces.

In the invention, the carrier is preferably provided with a carrier-type offset unit for moving the workpiece holder in the workpiece conveying direction.

According to the invention in which two lift beams are adjacent in the workpiece conveying direction, since the carrier-type offset unit moves the workpiece holder further beyond the range of movement in association with the movement of the carrier, the workpiece holder are correctly placed to the centers of the workstations, so that the same effects as described above can be obtained.

In the invention, the workpiece holder is preferably attached on the crossbar which is laid between the carriers facing toward each other with the workstation interposed therebetween, and the crossbar is provided with a crossbar-type offset unit for moving the workpiece holder in the workpiece conveying direction. In such a case, by providing the crossbar-type offset unit on the crossbar, the same effects as described above can be obtained.

In the invention described above, the case in which a crossbar is laid between the carrier-type offset units provided on the carriers and a workpiece holder is attached on the crossbar is also included in the invention because the offset unit is provided on the carrier.

DETAILED DESCRIPTION OF THE PREFERRED EMBODIMENTS

Figure 1:
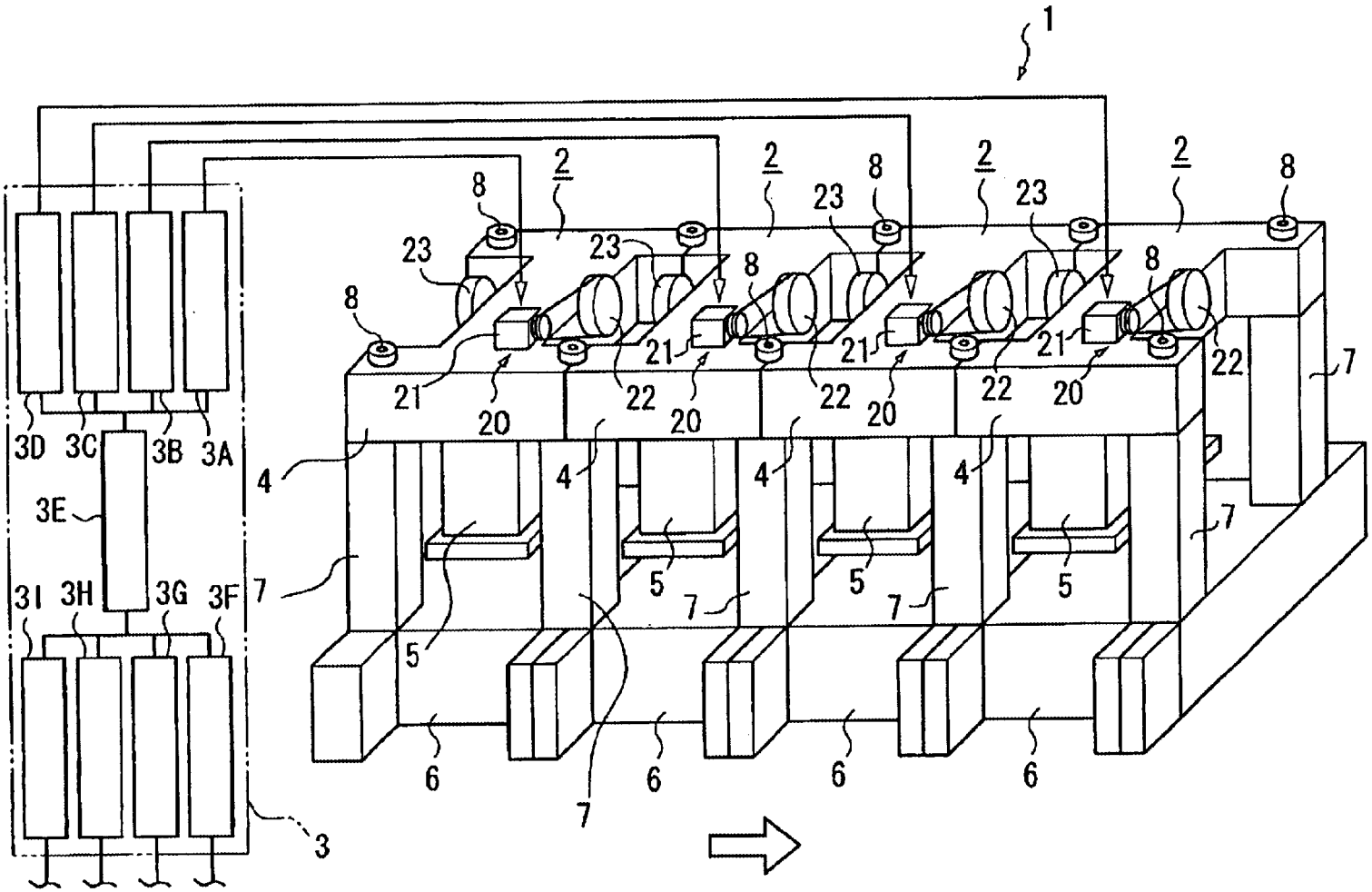
FIG. 1 is a general perspective view showing the frame format of the transfer press in which the transfer feeder according to the first embodiment of the invention is installed.

Referring now to the drawings, the respective embodiments of the invention will be described below.

In the second and third embodiments that will be described later, the same parts and the parts having the same capabilities as the parts described in conjunction with the first embodiment will be represented by the same reference numerals and the description will be simplified or will not be made again.

First Embodiment

Figure 2:
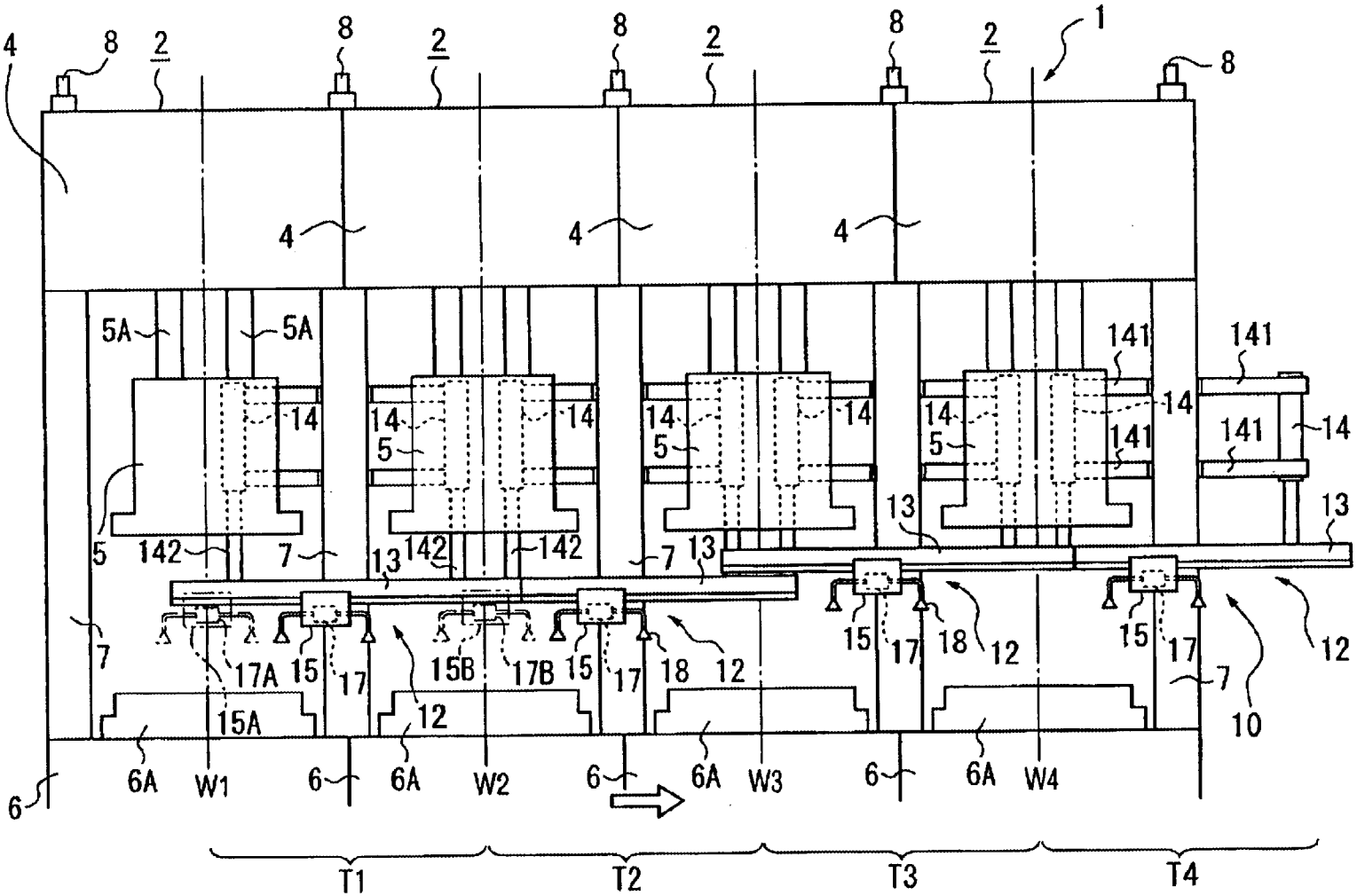
FIG. 2 is a front view of the transfer press according to the first embodiment of the invention, showing one operating mode of the transfer feeder.
Figure 3:
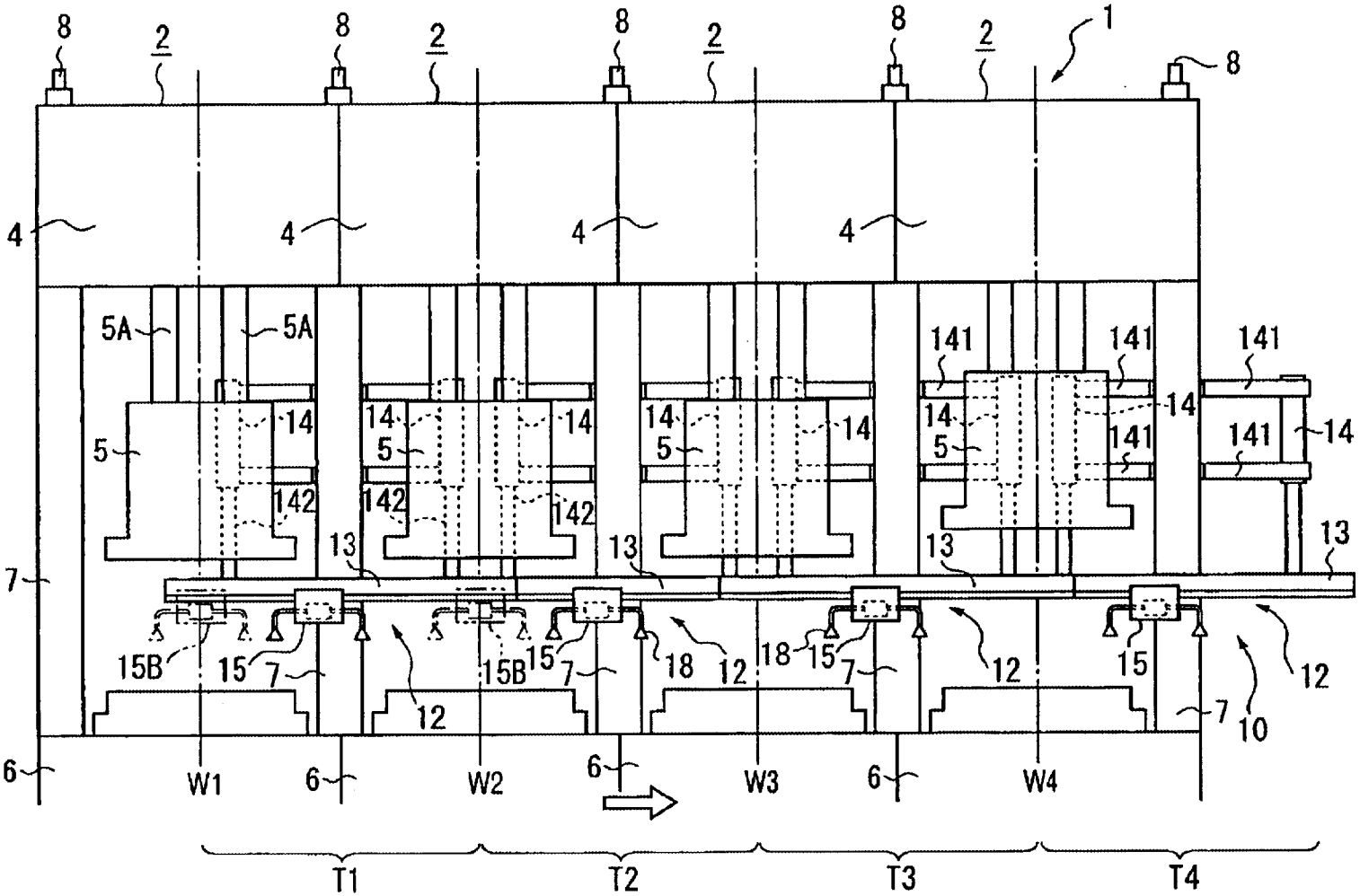
FIG. 3 is a front view of the transfer press according to the first embodiment, showing another operating mode of the transfer feeder.
Figure 4:
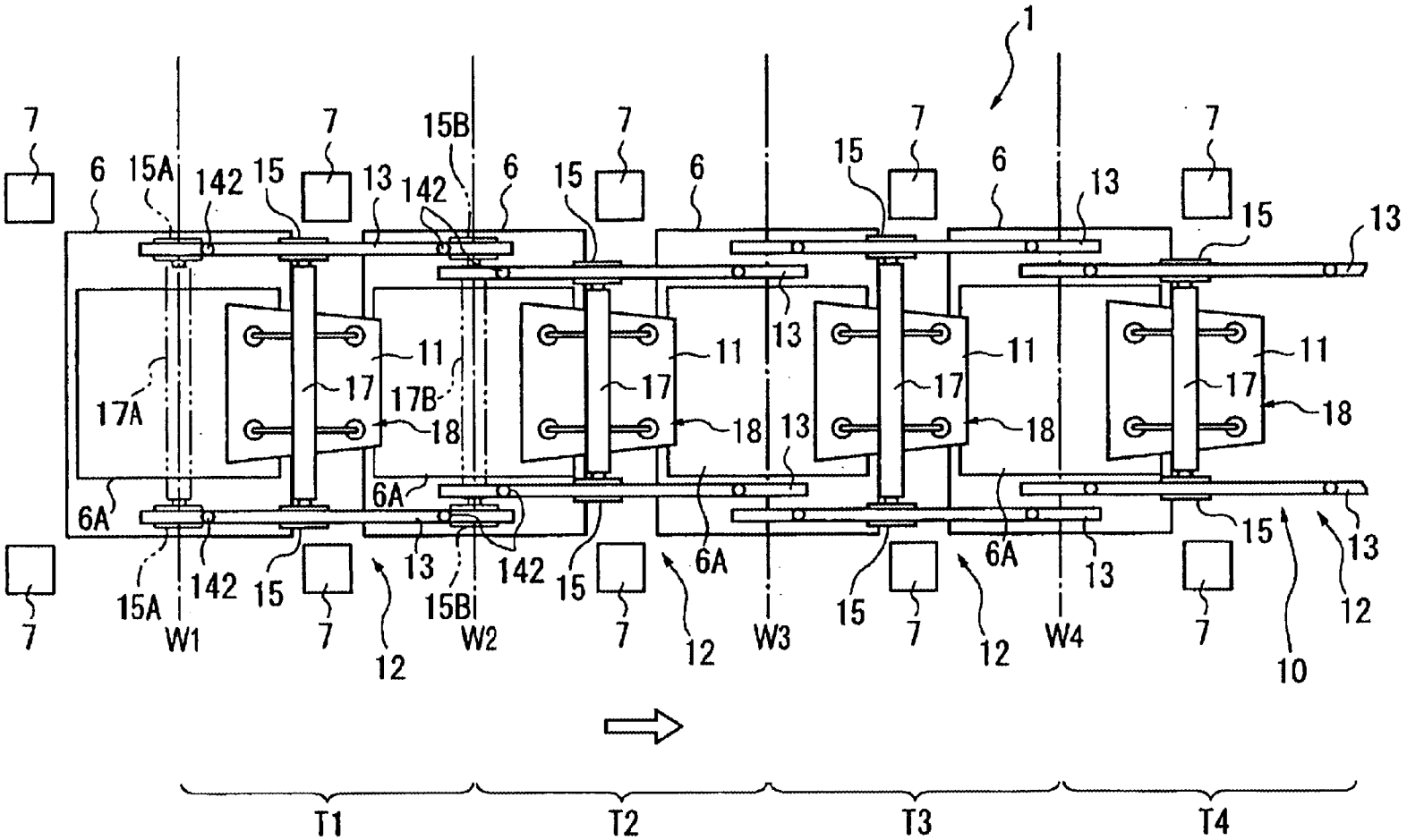
FIG. 4 is a plan view of the transfer press according to the first embodiment.
Figure 5:
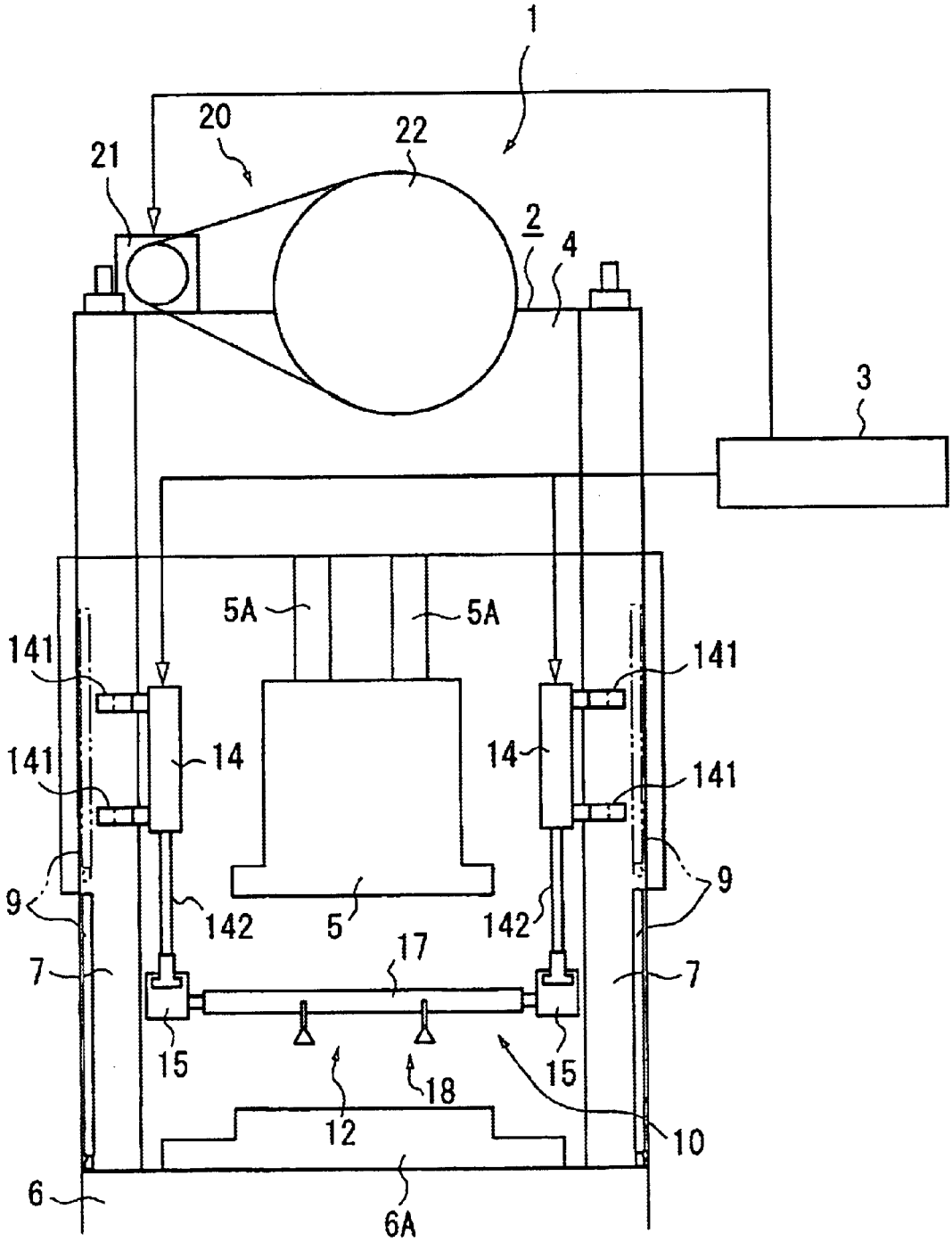
FIG. 5 is a side view of the transfer press according to the first embodiment.
Figure 6:
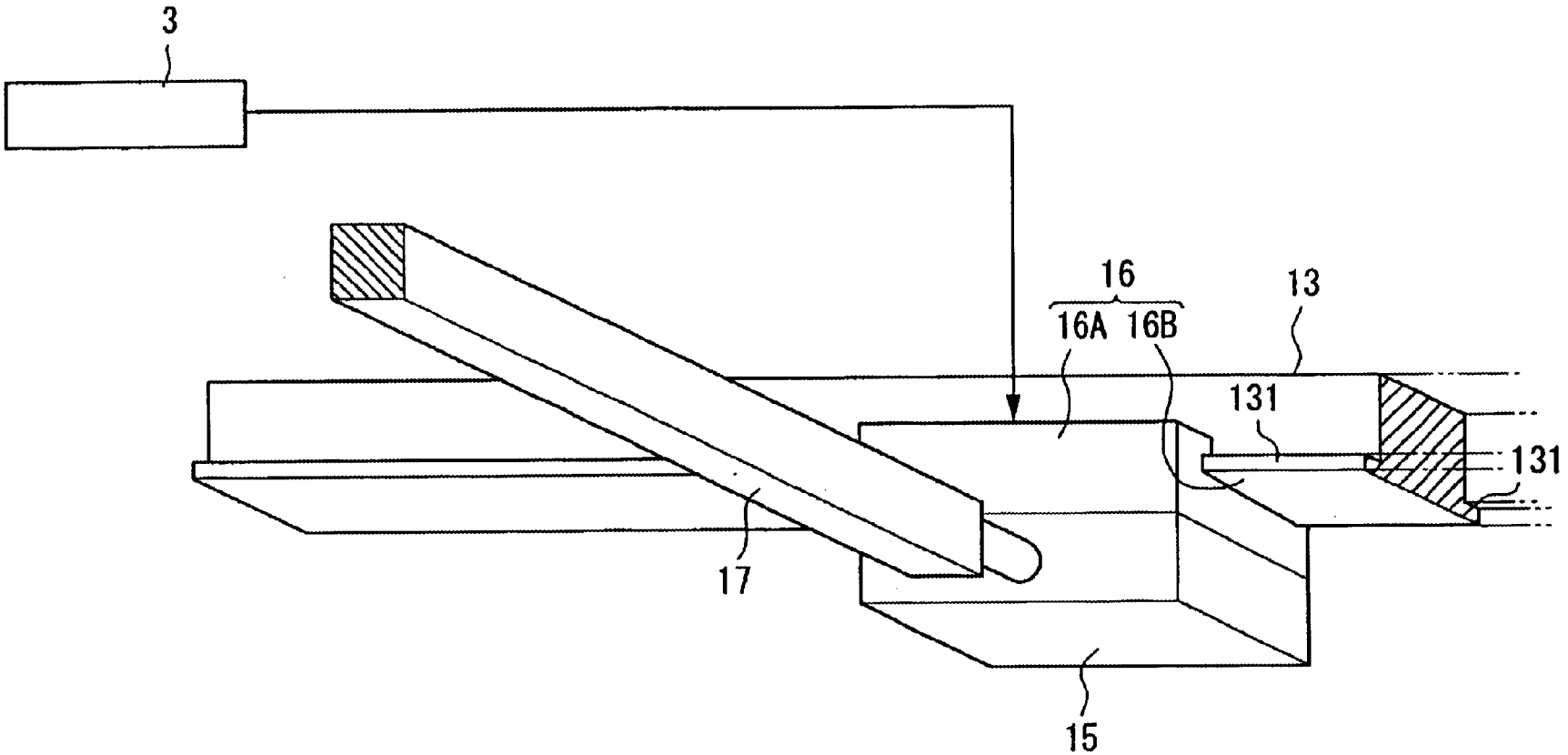
FIG. 6 is a perspective view of the principal portion of the transfer feeder according to the first embodiment, when viewed from below.

FIG. 1 is a general perspective view showing the frame format of a transfer press 1 in which the transfer feeder (not shown) according to the first embodiment of the invention is installed. FIG. 2 and FIG. 3 are front views of the transfer press 1, showing the different modes of operation of the transfer feeder. FIG. 4 and FIG. 5 are a plan view and a side view of the transfer press 1. FIG. 6 is a perspective view of the principal portion of the transfer feeder viewed from below.

The transfer press 1 will first be described.

As shown in FIG. 1 through FIG. 5, the transfer press 1 comprises a plurality (four in this embodiment) of module-type press units 2 are arranged along the workpiece conveying direction, and is provided with workstations W1–W4 corresponding to the respective press units 2.

The transfer press 1 comprises a controller 3 (FIG. 1) including a control panel and an operating panel, a stacker unit for feeding the workpieces, not shown, and a transfer feeder 10 of the invention that will be described later. In the transfer press 1 in such a construction, the workpieces 11 are conveyed from the left to the right in the figure (the left side is the upstream side, and the right side is the downstream side in the figure).

Each press unit 2 constructing the transfer press 1 comprises a set of a crown 4 including a driving force transmitting mechanism such as a clank mechanism, an eccentric mechanism, or a link mechanism integrated therein, a slide 5 connected to the driving force transmitting mechanism in the crown 4 via a plunger 5A for receiving the upper die mounted thereon, and a bed 6 provided with a moving bolster 6A for receiving the lower die mounted thereon. There is a case in which a normal bolster secured on the bed 6 is used instead of the moving bolster 6A. The die is not shown throughout the drawings.

Each section between the adjacent press units 2 is provided with two uprights 7 standing upright and being common for adjacent press units 2 so as to face toward each other in the direction orthogonal to the workpiece conveying direction in plan view. A tie rod 8 is passing vertically through the upright 7 and connecting the crown 4, the bed 6, and the upright 7 with respect to each other in one press unit 2. The adjacent press units 2 are connected by a tie bolt (not shown) tightened in the workpiece conveying direction. Provided between the uprights 7 is a guard fence 9 (FIG. 5) that can be opened or closed in the vertical direction.

Such uprights 7 and tie rods 8 are provided two each at the most upstream side and the most downstream side of the workpiece conveying direction as shown in the figure.

As shown in FIG. 1 and FIG. 5, the slide 5 in each press unit 2 is driven by a slide drive unit 20 provided at each press unit 2 (not shown in FIG. 2 and FIG. 3).

The slide drive unit 20 comprises a main motor 21 as a drive source, a flywheel 22 rotated by the main motor 21, a clutch, not shown, for intermittently transmitting rotational energy of the flywheel 22 to the drive force transmitting mechanism in the crown 4, and a brake 23 for stopping the movement of the slide 5 (sliding motion), and is disposed, for example, on the upper side of the crown 4.

The main motor 21, the flywheel 22, the clutch, and the brake 23 are extremely compact in comparison with the conventional members that drive all the slide at a time or a long and large scaled transfer bars, and thus total consumption of electric power including that of the lift shaft servomotor 14 and of the linear motor 16 is still lower than the conventional one.

The controller 3, being adapted to control the slide drive unit 20 of the press unit 2 to drive the slide 5, comprises W1–W4 controller 3A–3D for individually controlling the slide drive unit 20 of each press unit 2, and general controller 3E being responsible for control of the W1–W4 controller 3A–3D, and is constructed by a controlling technology using a computer.

The W1–W4 controller 3A–3D have respectively the same capabilities as the controller in a general single press, and control the slide drive units 20 of the corresponding workstations W1–W4 irrespective of other slide drive unit 20 to drive the slide 5 independently.

The general controller 3E has a capability of linking more than one controller (3A–3D) arbitrarily selected out of the W1–W4 controller 3A–3D with each other to control the same, and of controlling the slide drive units 20 of the workstations (W1–W4) corresponding to the selected controller (3A–3D) to drive the slides 5 simultaneously without phase difference or under the different conditions.

Therefore, such controller 3 can (1) control the slides 5 at all the workstations W1–W4 to be driven simultaneously without phase difference (simultaneous drive mode without phase difference), (2) determine the driving conditions for the slides 5 in all the workstations W1–W4 arbitrarily and control them to be driven simultaneously (simultaneous drive mode under the different conditions), (3) control the slides 5 at all the workstations W1–W4 to be driven independently (independent drive mode), and (4) control the slides 5 at all the workstations W1–W4 by the arbitrary combination of simultaneous drive without phase difference, simultaneous drive under the different conditions, and the independent drive (multi drive mode), and the W-1–W4 controller 3A–3D can maintain the slides 5 in the halt condition when the slides 5 are driven independently.

By selecting the arbitrary drive mode from the operation panel or the like, the controller 3 activates the controller (3A–3E) corresponding to the selected drive mode, and controls the operation of the transfer press 1.

The controller 3 is provided with T1–T4 controller 3F–3I for controlling the transfer feeder 10, which will be described later.

The transfer feeder 10 will now be described in detail.

The transfer feeder 10, being adapted to convey the workpieces 11 machined at the respective workstations W1–W4 toward downstream through the transfer areas T1–T4 established between the centers of the respective adjacent workstations W1–W4, comprises four feed units 12 disposed in the respective transfer areas T1–T4, as shown in FIG. 2, FIG. 3, and FIG. 5.

Each feed unit 12 comprises a pair of lift beams 13 (Though they correspond to the conventional transfer bars, the transfer bars in the invention do not have a transfer capability and have only a lifting capability. Therefore, they are referred to as "lift beams" hereinafter.) being disposed in parallel with each other along the workpiece conveying direction and spaced in the horizontal direction so as not to interfere with the sliding motion, lift shaft servomotors 14 as lift driving mechanism for driving the lift beams 13 in the vertical direction, carriers 15 mounted on the respective lift beams 13, a linear motor 16 (FIG. 6) as carrier driving mechanism for moving the carriers 15 along the length of the lift beams 13, a crossbar 17 laid between the carriers 15, and a vacuum cup unit 18 as workpiece holder provided on the crossbar 17, wherein the vacuum cup unit 18 is adapted to adsorb the workpiece 11 at a plurality of positions (four in this embodiment).

The lift beam 13 has a length as short as the conventional transfer bar divided almost equally into pieces so that the adjacent portions in the workpiece conveying direction are located every transfer areas T1–T4.

More specifically, the lift beam 13 is slightly longer than the length of the transfer areas T1–T4 (length in the workpiece conveying direction), and is arranged so that the same length are projected from the upstream side and from the downstream side in comparison with the transfer areas t1–T4 as shown in FIG. 2 to FIG. 4. As shown in FIG. 4, the lift beams 13 in the transfer areas T2, T4 are positioned inwardly of the lift beams 13 in the transfer area T1, T3, and in plan view, the end portions of the lift beams 13 being adjacent along the workpiece conveying direction are opposed with respect to each other in the direction orthogonal to the workpiece conveying direction (vertical direction in FIG. 4) at the positions corresponding to the centers of the workstations W1–W4 (shown by a dashed line in the figure).

At the lower side of such lift beams 13, there is provided a horizontal flange shaped guide portion 131 continuously projected along the length thereof as shown in FIG. 6.

The lift shaft servomotor 14 is supported by the upright 7 via a supporting member 141. When the servomotor 14 rotates a pinion, not shown, the vertical rod 142 provided with rack to be engaged therewith moves in the vertical direction, and the lift beam 13 in turn is moved in the vertical direction via the rod 142. The timing of activation and the speed of rotation of the servomotor 14 are preset by means of suitable input means provided on the operation panel or the like and controlled by the controller 3.

In this embodiment, one lift beam 13 is moved vertically by the use of two servomotors 14. However, one or more than two servomotor 14 may be used as far as the lift beam 13 can be moved naturally in the vertical direction in a stable manner, and the number of the servomotor 14 or the connecting structure with respect to the lift beam 13 can be determined arbitrarily at the time of implementation.

The linear motor 16 comprises, as shown in FIG. 6, a carrier side component 16A and a lift beam side component 16B. The carrier side component 16A engages the guide portion 131 of the lift beam 13 and moves along the same. The timing of movement or the speed of movement is preset and controlled by the controller 3. The linear motor 16 so constructed comprises a primary coil provided in the carrier side component 16A and a secondary conductor or a secondary permanent magnet in the lift beam side component 16B on the lower surface of the lift beam 13 so as to face toward the primary coil.

It is also possible to provide the primary coil in the lift beam side component 16B and the secondary conductor or the secondary permanent magnet in the carrier side component 16A so as to face toward the primary coil.

The carrier 15 is integrally mounted on the lower side of the carrier side component 16A of the linear motor 16, and moves along with the carrier side component 16A.

The crossbar 17 and the vacuum cup unit 18 mounted thereon, being the same as those used for a general transfer feeder, have a suitable rigidity and a reliable workpiece holding (adsorbing) force.

Referring again to FIG. 1, the T1–T4 controller 3F–3I of the controller 3 are capable of controlling the servomotor 14 and the linear motor 16 in the corresponding transfer areas T1–T4, and drive the lift beam 13 and the carrier 15 independently by transfer area T1–T4 basis under the driving conditions including a prescribed driving timing, driving speed, driving amount (lifting amount, feeding amount), and so on.

The T1–T4 controller 3F–3I also control the relative movement between the servomotor 14 and the linear motor 16 for each transfer area T1–T4, so that the movement of the lift beam 13 and the movement of the carrier 15 are linked.

The general controller 3E for the controller 3 serves to control at least two controlling member (3F–3I) that are arbitrarily selected out of T1–T4 controller 3F–3I in the linked state, controls the servomotor 14 and the linear motor 16 of the transfer areas (T1–T4) corresponding to the selected controller (3F–3I), and drives the respective lift beams 13 and the carriers 15 simultaneously between the transfer areas (T1–T4) without phase difference or under the driving condition that is arbitrarily determined.

In addition, the general controller 3E, being able to control W1–W4 controller 3A–3D and T1–T4 controller 3F–3I in the linked state, links the sliding motion in the respective workstations W1–W4 and the movement of the lift beams 13 and the carriers 15 in the transfer areas T1–T4.

Therefore, with this controller 3 can (1) control the lift beams 13 and the carriers 15 respectively to be driven simultaneously in all the transfer areas T1–T4 without phase difference, and under the same driving conditions such as the driving timing, driving speed, and driving amount (simultaneous drive mode without phase difference), (2) determine the driving conditions for the lift beam 13 and the carriers 15 in all the transfer areas T1–T4 arbitrarily to drive them simultaneously with respect to each other (simultaneous drive mode under the different conditions), (3) control to determine the driving conditions arbitrarily and to drive all the lift beams 13 and the carriers 15 independently in each transfer area T1–T4 (independent drive mode), and (4) control them by the arbitrary combination of simultaneous drive without phase difference, simultaneous drive under the different conditions, and the independent drive (multi drive mode) depending on the sliding motion on side of the transfer press 1, and the lift beams 13 and the carriers 15 may be maintained in the halt condition when being driven independently by T1–T4 controller 3F–3I.

In addition, by selecting an arbitrary drive mode from the operating panel or the like, the controller 3 activates the controller (3E–3I) according to the selected drive mode, and controls the operation of the transfer feeder 10.

The typical way of conveyance of the workpiece 11 by the transfer feeder 10 described above will now be described.

In the transfer area T1, when process in the workstation W1 is finished and the slide 5 starts to move upward, the carrier 15 of the lift beam 13 located at a prescribed level is moved along the lift beam 13 toward the end on the side of the workstation W1 (See the carrier 15A and crossbar 17A shown by the chain double-dashed line in FIG. 2, FIG. 3 and FIG. 4), then the vacuum cup unit 18 is moved toward the center of the workstation W1, and the lift beam 13 is moved downward at this position to adsorb the workpiece 11.

Subsequently, the lift beam 13 is moved upward, the carrier 15 is moved to the end on the side of the workstation W2 (See the carrier 15B and the crossbar 17B shown by the chain double-dashed line in FIG. 4), the vacuum cup unit 18 is positioned at the center of the workstation W2, and the lift beam 13 is moved downward at this position to release the workpiece 11. Then, the lift beam 13 is moved upward before the slide 5 in the workstation W2 is moved completely downward, or before the process in the workstations W2 starts, and the carrier 15 is moved back to the substantially center of the transfer area T1 so as not to interfere with the slide 5 or the die.

When the process in the workstation W2 is finished, the lift beam 13 and the carrier 15 is driven in the transfer area T2 in the same manner as the feed unit 12 in the transfer area T1.

The feed unit 12 is driven in the same manner in the transfer area T3, T4 as well, the workpiece is carried in and out through all the transfer areas T1–T4, and end up with being carried out from the transfer area T4 to the discharge unit and the like, not shown.

Actually, the carrier 15 is moved not in a state in which the lift beam 13 remains stationary, but in a state in which the lift beam 13 is moving in the vertical direction. It enables effective conveyance and thus the process speed may be increased.

A typical operating mode of the transfer press 1 and the transfer feeder 10 will be explained with drive mode below.

Operating Mode A

Transfer Press, Transfer Feeder: Simultaneous Drive Mode Without Phase Difference In this operating mode, the slides 5, the lift beams 13, and the carriers 15 are driven respectively simultaneously in all the press units 2 and the feed units 12 without phase difference, and the transfer press 1 and the transfer feeder 10 are operated in the same manner as the related art.

In other words, the slides 5 are driven simultaneously without phase difference and the workpieces 11 are machined almost simultaneously in all the workstations W1–W4. Then, immediately after machining of the workpieces 11 is finished and the respective slides 5 start to move upward, the lift beams 13 and the carriers 15 of the transfer feeder 10 are driven respectively simultaneously at the same driving speed by the same driving amount in all the transfer areas T1–T4 without phase difference to feed the workpieces 11 to the next process at a time.

At this moment, in the controller 3, all the W1–W4 controller 3A–3D, T1–T4 controller 3F–3I are being activated, and the general controller 3E are controlling all these controller 3A–3D, 3F–3I in the linked state.

Operating Mode A is performed by selecting the "simultaneous drive mode without phase difference" as a driving mode for both of the transfer press 1 and the transfer feeder 10 on the operating panel of the controller 3.

Operating Mode B

Transfer Press: "Simultaneous Drive Mode Without Phase Difference", Transfer Feeder: "Simultaneous Drive Mode Under the Different Conditions"

In this operation mode, the transfer press 1 is operated as in the related art, and the transfer feeder 10 is operated as in the case of the conveyer in the tandem press line. The state in this operating mode is shown in FIG. 2.

According to FIG. 2, in the transfer press 1, the slides 5 in all the workstations W1–W4 are driven simultaneously without phase difference.

On the other hand, in the transfer feeder 10, the lift beams 13 and the carriers 15 are driven simultaneously at the same driving speed by the same driving amount in the transfer areas T1, T2. In contrast to it, conveying operation out from the workstation W3 in the transfer area T3 is made under the same driving conditions as in the transfer areas T1, T2, while conveying operation into the workstation W4 is performed under the different conditions in driving speed and driving amount from the transfer areas T1, T2. In the transfer area T4, conveying operation out from the workstation W4 in the transfer area T4 is made under the different driving conditions in driving speed and driving amount from those in the transfer areas T1, T2, and discharging operation to the discharging unit, not shown, is made under the same driving conditions as the transfer areas T1, T2.

In this operating mode, in the transfer areas T1, T2, when the process for all the workpieces 11 is finished almost at the same time and the slides 5 start to move upward, the lift beams 13 and the carriers 15 are driven simultaneously to start conveyance.

However, when the size of the die at the workstation W4 is slightly larger than those in other workstations W1–W3 for example, the workpiece 11 in the transfer area T3 is discharged from the workstation W3 at the same timing as in the transfer areas T1, T2. However, after discharge, the lift beams 13 and the carriers 15 are halted at the position where the die and the workpiece 11 do not interfere with each other until the slide 5 of the workstation W4 moves upward to the sufficient level, or is driven at a low speed considering interference so that transfer of the workpiece 11 into the workstation W4 is delayed.

On the other hand, in the transfer area T4, the lift beams 13 and the carriers 15 are halted or driven at a low speed to avoid interference until the slide 5 is moved upward to the sufficient level to delay transfer of the workpiece 11 out from the workstation W4, and after the workpiece is transferred, the workpiece 11 is transferred to the discharge unit, not shown, at the same timing as the transfer area T1, T2.

In this arrangement, even when the size of the die at the workstation W4 is more or less larger, transfer of the workpiece 11 can be carried out without interference with the die freely.

In the transfer areas T3, T4, from the moment that the slide 5 reaches the sufficient level, the lift beams 13 and the carriers 15 may be driven at a high speed with a motion with acceleration applied to the vacuum cup unit 18 suppressed. Accordingly, transfer of the workpieces 11 into or from all the transfer areas T1–T4 may be completed almost simultaneously, so that all the slides 5 can be driven immediately for the next process.

Even when the size of the die in other arbitrary workstations other than the workstation W4 is large, transfer of the workpieces 11 can be carried out freely by controlling in a same manner.

At this moment as well, in the controller 3, all the W1–W4 controller 3A–3D and the T1–T4 controller 3F–3I are being activated, and the general controller 3E controls all these controller 3A–3D, 3F–3I in the linked state.

On the operating panel of the controller 3, the "simultaneous drive mode without phase difference" is selected as a drive mode of the transfer press 1, and the "simultaneous drive mode under the different conditions" is selected as a drive mode of the transfer feeder 10, and then the driving conditions to be differentiated among the lift beams 13 and the carriers 15 is selected.

Operating Mode C

Transfer Press: "Simultaneous Drive Mode Under the Different Conditions", Transfer Feeder: "Simultaneous Drive Mode without Phase Difference"

In this operation mode, a part or all of the transfer press 1 is operated as a tandem press, and the transfer feeder 10 is operated as in the related art. The state in this operating mode is shown in FIG. 3.

In a first place, the simultaneous drive mode with an arbitrary phase difference will be described out of the driving modes of each slide 5 under the different conditions.

According to FIG. 3, in the transfer press 1, the slide 5 in the workstation W4 is driven simultaneously but earlier by a prescribed phase difference with respect to the slides 5 in the workstations W1–W3. In this case, the slides 5 in other workstations W1–W3 are driven simultaneously without phase difference with each other.

On the other hand, in the transfer feeder 10, the lift beams 13 and the carriers 15 are driven respectively simultaneously without phase difference under the same driving conditions in all the transfer areas T1–T4.

In such operating mode, the slide 5 in the workstation W4 is moved downward in a first place and subsequently the respective slides 5 in the workstations W1–W3 are moved downward at a time. Then, in all the transfer areas T1–T4, when the process of the workpieces 11 in the workstations W1–W3 is finished and the slides 5 start to move upward, all the lift beams 13 and the carriers 15 are driven at a time to start transfer.

Accordingly, in the transfer area T4, when the lift beams 13 and the carriers 15 are driven to adsorb the workpiece 11, the slide 5 in the workstation W4 is positioned higher than the slides 5 of other workstations W1–W3. Therefore, even when such process that the height (vertical dimension) of the workpiece 11 machined in the workstation W4 increases such as deep drawing is performed, such workpieces 11 do not interfere with the die or the like, and thus are transferred without problem.

In the case where the height of the workpiece 11 in other arbitrary workstation other than the workstation W4 is large, the workpiece 11 can also be transferred without problem by controlling in the same manner.

The upper dead point stop per cycle out of the drive modes under the different conditions for each slide 5 will now be described.

For example, the case where deep-draw molding is performed in the workstation W1 is assumed. In the workstation W1, it is required that the slide 5 is driven at a low speed so that no crack is generated on the workpieces 11. However, in other workstations W2–W4, it is required to move the slides 5 upward quickly in order to facilitate transfer of the workpieces. Further, both of them must be operate in the same cycle time. Therefore, in the workstations W2–W4, the slide 5 is driven earlier than in the workstation W1, and then the slide 5 stops at the upper dead point, so as to be operated in the same cycle time as the workstation W1.

Accordingly, design of the die is facilitated, the process accuracy with respect to the productivity is improved, and shortening of the lifetime of the die due to improvement of the productivity can be prevented.

In such operation, the general controller 3E controls all the W1–W4 controller 3A–3D and the T1–T4 controller 3F–3I in the linked state. On the operation panel of the controller 3, the "simultaneous drive mode under the different conditions" is selected as a drive mode of the transfer press 1, and which phase of the slide 5 is to be shifted is selected, and then the "simultaneous drive mode without phase differences" is selected as a drive mode of the transfer feeder 10.

Operation Mode D

Transfer Press, Transfer Feeder: Both in the "Independent Drive Mode"

In this operation mode, the selected arbitrary slides 5, the lift beams 13, and carriers 15 are independently driven. Though it is not shown in the figure, for example, the slide 5, the lift beams 13, and the carriers 15 are driven only in the workstation W1 and the transfer area T1, and operation in other workstations W2–W4 and the transfer areas T2–T4 is entirely stopped.

In this mode, one each of press unit 2 and feed unit 12 constitutes an independent press (line).

In this case, in the workstation W1 that is to be driven, the process like an independent press is carried out, and the workstation W2 in the downstream for example is used as a station in which the machined workpieces 11 are stacked. Then, the driving conditions for the lift beams 13 and the carriers 15 are determined so that interference between the workpiece 11 and the die is eliminated and the machined workpieces 11 can be piled one on another.

In the unit 2 of the workstations W2–W4 which are being halted, the main motor 21 of the slide drive unit 20 is being halted, and the flywheel 22 is not being rotated, thereby saving energy correspondingly.

The number of slides 5 to be driven may be one, or may be two or more that are driven independently. When driving a plurality of slides, the adjacent slides 5 may be driven, or the slides located apart from each other may be driven.

In the transfer feeder 10 in this case, the lift beams 13 and the carriers 15 must simply be driven in the transfer areas (T1–T4) at the positions corresponding to the slides 5 to be driven. However, the lift beams 13 and the carriers 15 may be driven in all the transfer areas T1–T4 even when only one slide 5 is driven for example. Consequently, the workpiece 11 can be transferred into the transfer press 1 from the upstream-most stack unit, machined at an arbitrary position, and then discharged by the downstream-most discharge unit.

In the controller 3, the W1, T1 controller 3A, 3F corresponding to the workstation W1 and the transfer area T1 as well as the general controller 3E for linking them with each other are being activated, and other W2–W4, T2–T4 controller 3B–3D, 3G–3I are not activated.

On the operating panel of the controller 3, the "independent drive mode" is selected as a drive mode for both of the transfer press 1 and the transfer feeder 10, and the slide 5, lift beam 13, and carrier 15 to be driven are selected.

According to this embodiment, the following effects are expected.

(1) In the transfer feeder 10, since the shorter lift beams 13 are employed instead of conventional long and large scaled transfer bar, a compact servomotor 14 for moving the lift beams 13 in the vertical direction and the compact linear motor 16 for the carrier 15 that moves along the lift beam 13 must only be driven in order to convey the workpiece 11, and thus total consumption of electric power of all the servomotors 14 and the linear motors 16 is significantly lower than the case where the conventional transfer bar is driven by a large main motor and the servomotor, thereby promoting energy saving.

(2) By controlling the servomotor 14 and the linear motor 16 of the transfer feeder 10 by the respective controller 3A–3I of the controllers 3, the lift beams 13 and the carriers 15 in the transfer areas T1–T4 can be driven under the arbitrary driving conditions. Therefore, by controlling the lift beam 13 and the carrier 15 according to the size or the configuration of the die, the lift beam 13 and the carrier 15 can always be driven without any interference with the die irrespective of the size, the configuration, or the like of the die, so that the conventional design constraints of the die are alleviated and design freedom of the die increases.

(3) With the design constraints of the die being alleviated, the die used in the conventional tandem press or in the independent press may be used without significant modification, and thus time, efforts, and cost for manufacturing the additional die may be reduced.

(4) Even in the case where the die which is more or less larger in size is employed, as is described in conjunction with Operating Mode B, the transfer of the workpieces 11 into or from all other transfer areas (T1–T4) may be completed simultaneously by shifting the timing for activating and halting the lift beam 13 and the carrier 15 in the transfer areas (T1–T4) or by driving them at a high speed in a motion with acceleration applied to the vacuum cup unit 18 suppressed, whereby the desired transfer efficiency can be maintained.

(5) Since the lift beams 13 is shorter than the length of each transfer area T1–T4 because the adjacent portions in the workpiece conveying direction are provided at each workstations W1–W4, the servomotor 14 can further be downsized in association with further reduction in size and weight of the lift beam 13.

Since the size and number of the lift beams 13, the servomotors 14, the rods 142, the carriers 15, the linear motors 16, and the vacuum cup units 18 are the same in all the feed units 12 except for the crossbars 17, the number of the kind of the member can be reduced, and thus the manufacture of the feed units 12 can be facilitated.

Since the transfer feeder 10 is constructed as a feed unit in each transfer area T1–T4, the optimal feed motion can be produced for each transfer area T1–T4, and thus the design freedom of the die can be increased significantly, and thus the production of the die can further be facilitated. When producing feed motion, only the adjacent transfer areas T1–T4 must be considered. Therefore, acceleration generated at the lift beam 13 can be minimized and thus the transfer feeder 10 can reliably follow the transfer press 1 operated at a high speed in association with reduction of the weight of the lift beam 13.

(6) Since the adjacent ends of the lift beams 13 in the workpiece conveying direction in the adjacent transfer areas T1–T4 face toward each other in the direction orthogonal to the workpiece conveying direction in plan view, both of the vacuum cup units 18 on the upstream side and on the downstream side can be pulled into the centers 15 of the workstations W1–W4 by moving the carriers of the respective lift beams 13 toward the facing portions alternately. Therefore, by attaching and detaching the workpieces 11 at these positions, transfer can be performed reliably without using a specific offset unit.

(7) As in the case of Operating Mode A described above, the transfer press 1 or the transfer feeder 10 can be operated in the conventional manner by driving the slides 5, the lift beams 13, and the carriers 15 simultaneously without phase difference in all the workstation W1–W4 and the transfer areas T1–T4.

(8) By driving the slides 5 earlier by a prescribed phase difference as in the case of Operating Mode C, even when the dies of the original size in the transfer press 1 are used and the lift beams 13 and the carriers 15 are driven by the original motion of the transfer feeder 10 (simultaneous drive without phase difference at the same driving speed by the same driving amount), the press unit 2 in the earlier phase can perform the process such as deep drawing, which has been difficult to realize in the related art, and can transfer such workpieces 11 out without problem. In addition, by performing the upper dead point stop per cycle, the process such as deep drawing can be performed reliably while maintaining productivity.

(9) By driving all the slides 5, the lift beams 13, and the carriers 15 independently as in the case of Operating Mode D, each press unit 2 and the feed unit 12 can be treated as a single press machine or a feed unit. Therefore, it can be used for machining with a die for a single press machine even when transfer process is not performed, and various processing may be realized by driving the lift beam 13 and the carrier 15 under the driving conditions corresponding to the size of the die.

(10) Since the main motor 21 is provided for each press unit 2, it can be significantly downsized with respect to the conventional main motor that has been used for driving all the slides 5, and total consumption of electric power of all the main motors 21 and the aforementioned servomotors 14 and the linear motors 6 can be significantly reduced in comparison with the related art, thereby promoting energy saving.

(11) Since the main motor 21 is downsized, the flywheel 22, the clutch, and the brake 23 constituting the slide drive unit 20 can be downsized in comparison with those in the related art, and thus these members can be procured quickly at lower cost. Therefore, it is easy to have these members in reserve in the factory or the like, so that even when replacement of these member is required due to failure or the like, it can be replaced quickly without halting the production line for a long time, thereby preventing much troubles on the production.

Second Embodiment

Figure 7:
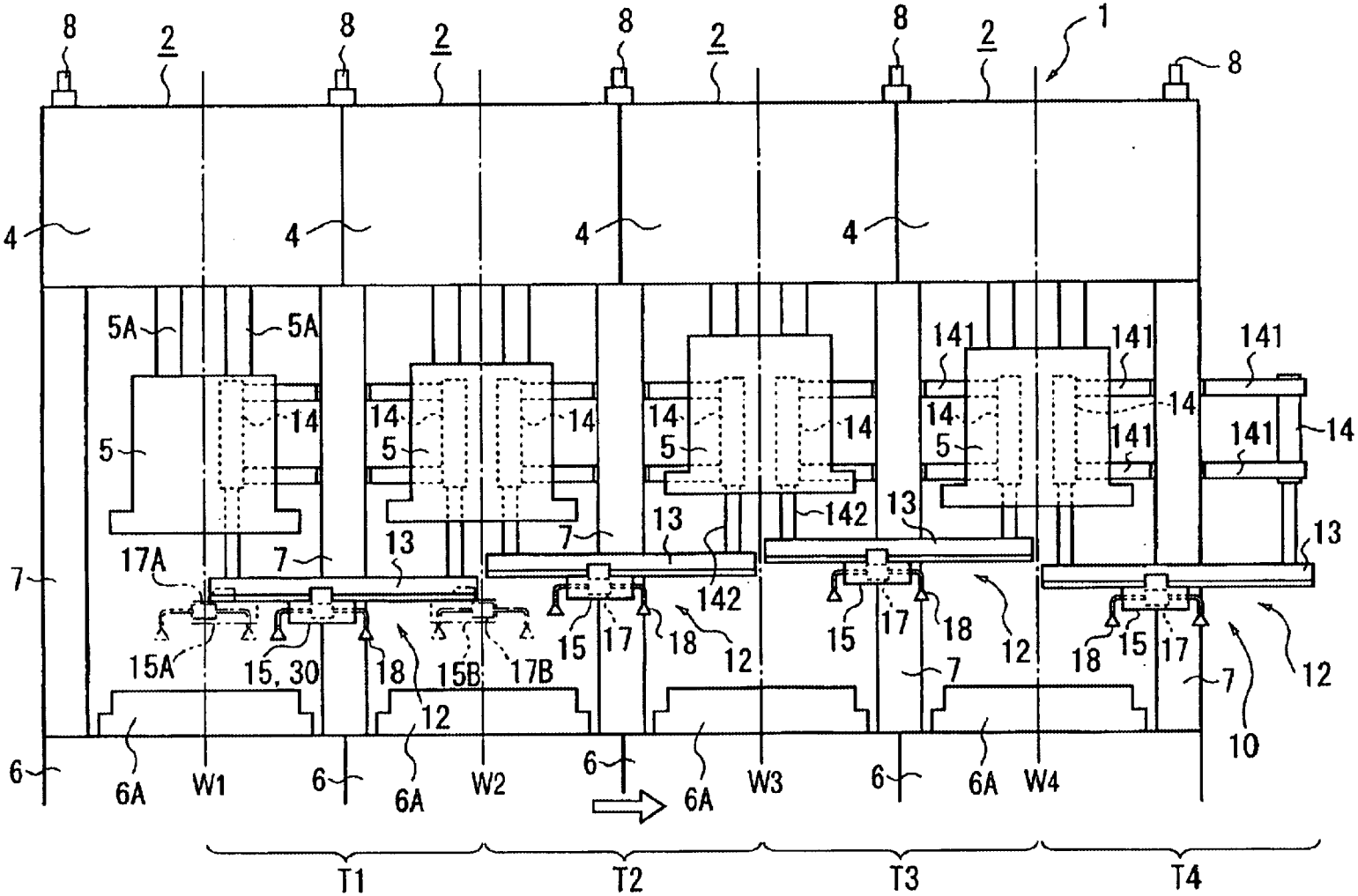
FIG. 7 is a front view of the transfer press in which the transfer feeder according to the second embodiment of the invention is installed.
Figure 8:
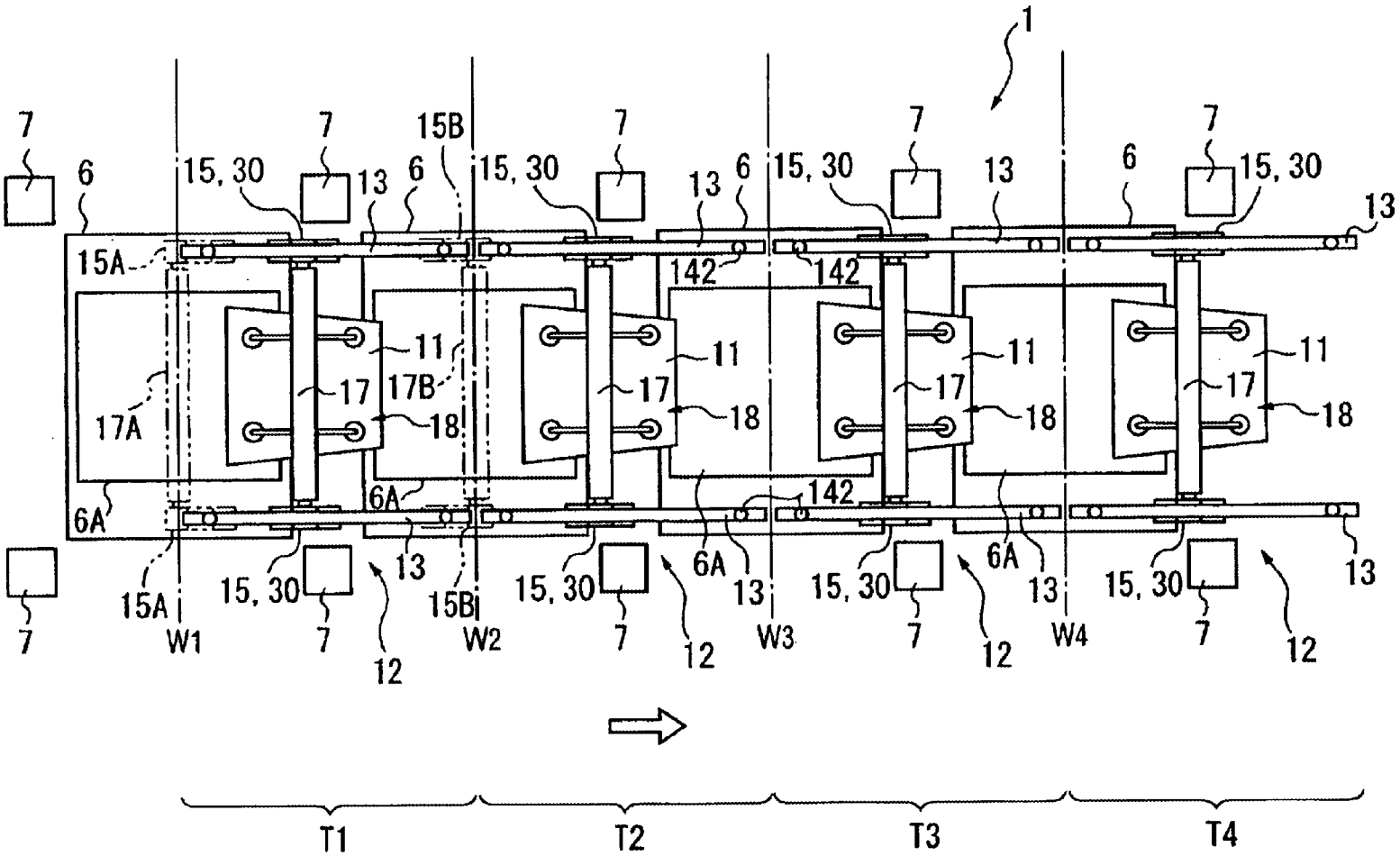
FIG. 8 is a plan view of the transfer press according to the second embodiment.
Figure 9:
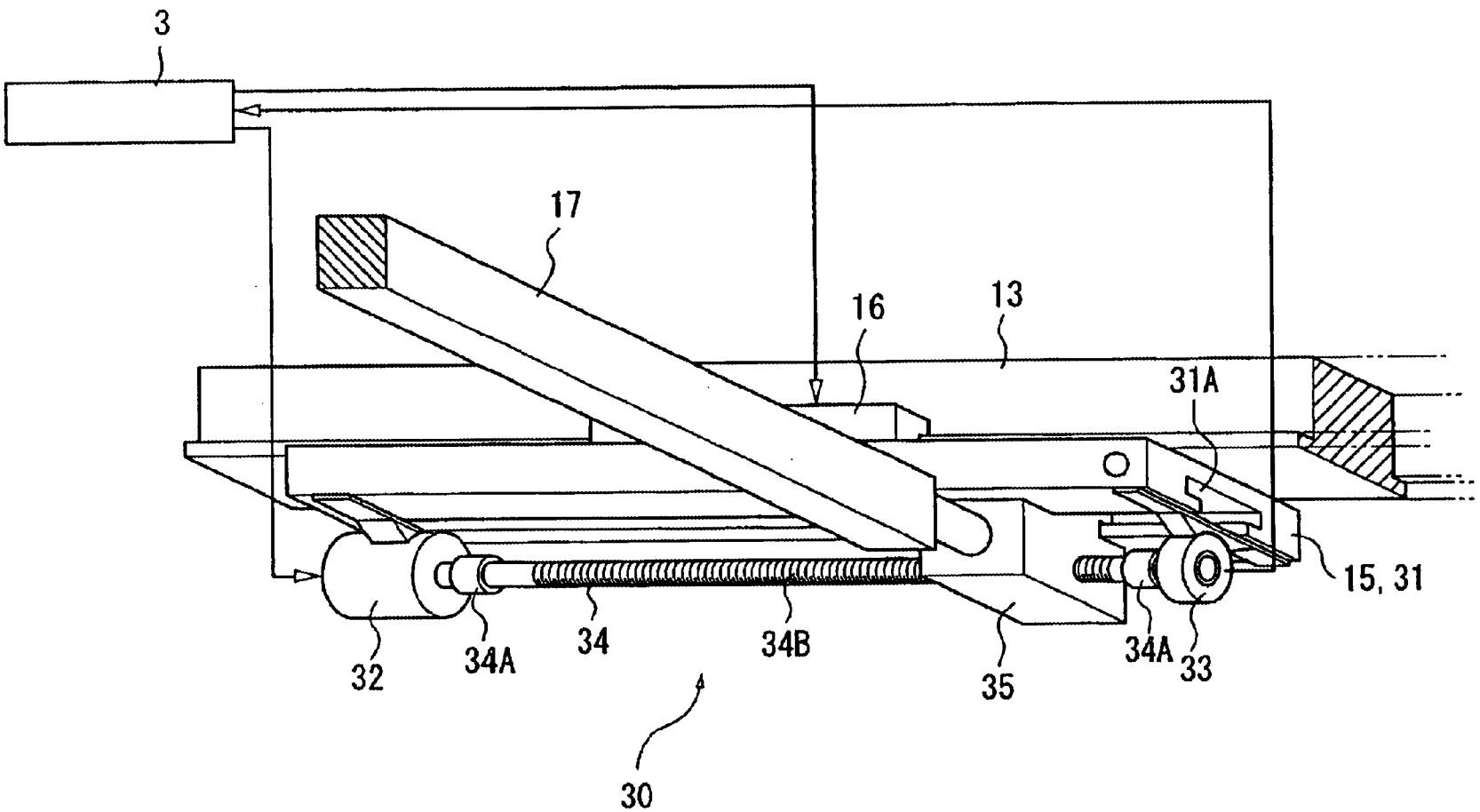
FIG. 9 is a perspective view of the principal portion of the transfer feeder according to the second embodiment when viewed from below.

Referring now to FIG. 7, FIG. 8, and FIG. 9, the transfer feeder 10 according to the second embodiment of the invention will be described.

In FIG. 7 and FIG. 8, the lift beams 13 used in the transfer feeder 10 in this embodiment is slightly shorter than the length of each transfer area T1–T4 (the length in the workpiece conveying direction) provided at equal pitches. As shown in FIG. 8, the end portions of the lift beams 13 being adjacent along the workpiece conveying direction in plan view are spaced in the workpiece conveying direction (lateral direction in FIG. 4) facing with each other at the positions corresponding to the centers of the workstations W1–W4, and disposed in alignment with each other through the transfer areas T1–T4.

In FIG. 9, the carrier 15 in this embodiment is provided with a carrier-type offset unit 30.

The carrier-type offset unit 30 comprises a prescribed length of a base plate 31, serving also as a carrier 15, provided with a guide groove 31A along the workpiece conveying direction, a motor 32 provided on the lower surface on one side in the longitudinal direction of the base plate 31, an encoder 33 provided on the lower surface on the other side of the base plate 31, a shaft 34 connected to the motor 32 at one end via a coupling 34A and supported by a encoder 33 at the other end via the coupling 34A, and a movable block 35 being engaged with the male screw portion 34B provided on the outer surface of the shaft 34 and fitted into the guide groove 31A of the base plate 31, and the end of the crossbar 17 is connected to the movable block 35.

In the carrier-type offset unit 30 in this construction, the shaft 34 is driven by the motor 32 during travel of the carrier 15, and the movable block 35 engaged therewith is slid along the guide groove 31A.

In other words, at each lift beam 13, when the carrier 15 is located at the end of the upstream side as seen in the workpiece conveying direction, the movable block 35 is also moved to the upstream side (See the carrier 15A and the crossbar 17A shown by the chain double-dashed line in FIG. 7 and FIG. 8), and the vacuum cup unit 18 mounted on the crossbar 17 is moved to the center of the workstation W1–W4.

In contrast to it, when the carrier 15 is at the end of the downstream side, the movable block 35 is also moved to the downstream side (See the carrier 15B and the crossbar 17B shown by the chain double-dashed line in FIG. 7 and FIG. 8), and the vacuum cup unit 18 is moved to the center of the workstation W2–W4 (an optional position on the discharge unit which is not shown in the transport area T4).

Accordingly, the vacuum cup unit 18 is offset in the workpiece conveying direction, and the workpiece 11 is attached and detached at the centers of the workstation W1–W4 so that they are reliably transferred.

The offset amount in this case is controlled by the controller 3 which controls the number of revolutions of the motor 32 based on the output from the encoder 33.

The operating mode of the transfer press 1 and the transfer feeder 10 in this embodiment will now be described.

Operating Mode E

Transfer Press, Transfer Feeder: Both in the "Simultaneous Drive Mode Under the Different Conditions"

In this operating mode, the transfer press 1 and the transfer feeder 10 are operated in combination as a tandem press line, and the operation is shown in FIG. 7.

In this operation, the lift beams 13 and the carriers 15 are driven under the different driving conditions according to the size of the die in the workstations W1–W4, and the vertical size of the machined workpieces 11. The driving conditions are determined so that the relative positioning of the slides 5 is considered to prevent interference with the die and useless movement from being occurred.

In this case, in the controller 3, all the W1–W4 controller 3A–3D, and T1–T4 controller 3F–3I are activated and the general controller 3E controls all these controller 3A–3D and 3F–3I in the linked state.

On the operating panel of the controller 3, the "simultaneous drive mode under the different conditions" is selected as a drive mode for the transfer press 1 and of the transfer feeder 10 respectively.

Though only Operating Mode E is described in this embodiment, Operating Modes A to D described in conjunction with the first embodiment may be realized by selecting suitable drive mode as a matter of course.

According to this embodiment, the following effects are expected.

(12) In this embodiment, since the slides 5 are driven simultaneously under the different conditions, and the lift beams 13 and the carriers 15 are driven under the arbitrary driving conditions, Operating Mode E can be implemented and thus the transfer press 1 and the transfer feeder 10 can be operated in combination almost exactly the same as the tandem press line.

(13) Since Operating Modes A to D can be implemented as in the case of the first embodiment depending on the selection of the drive mode, a single transfer press 1 and a transfer feeder 10 can realized original capabilities of the transfer press 1, capabilities of the tandem press line, and capabilities of an independent press line, thereby realizing further variations in machining.

(14) Since the transfer feeder 10 comprises the lift beams 13 disposed in alignment along the workpiece conveying direction, the crossbars 17 may all be the same length in this embodiment, while two lengths of crossbars 17 are required in the first embodiment, whereby the components for all the feed units 12 may be the same, thereby eliminating complication in manufacture.

(15) Further, since the lift beams 13 are disposed in alignment, the width space of the transfer areas T1–T4 defined by a pair of lift beams 13 with the transfer areas T1–T4 interposed therebetween may be increased in comparison with the case of the first embodiment, enough space may be ensured between the lift beam 13 and the die, and thus design of the die may further be facilitated.

(16) Since the carrier-type offset unit 30 is provided on the carrier 15, even when the adjacent end portions of the lift beams 13 in the adjacent transfer areas T1–T4 face toward each other in the work piece conveying direction, the workpieces 11 can be attached and detached at the center of the workstation w1–W4 by offsetting the vacuum cup unit 18, whereby the workpiece 11 is reliably transferred.

Third Embodiment

Figure 10:
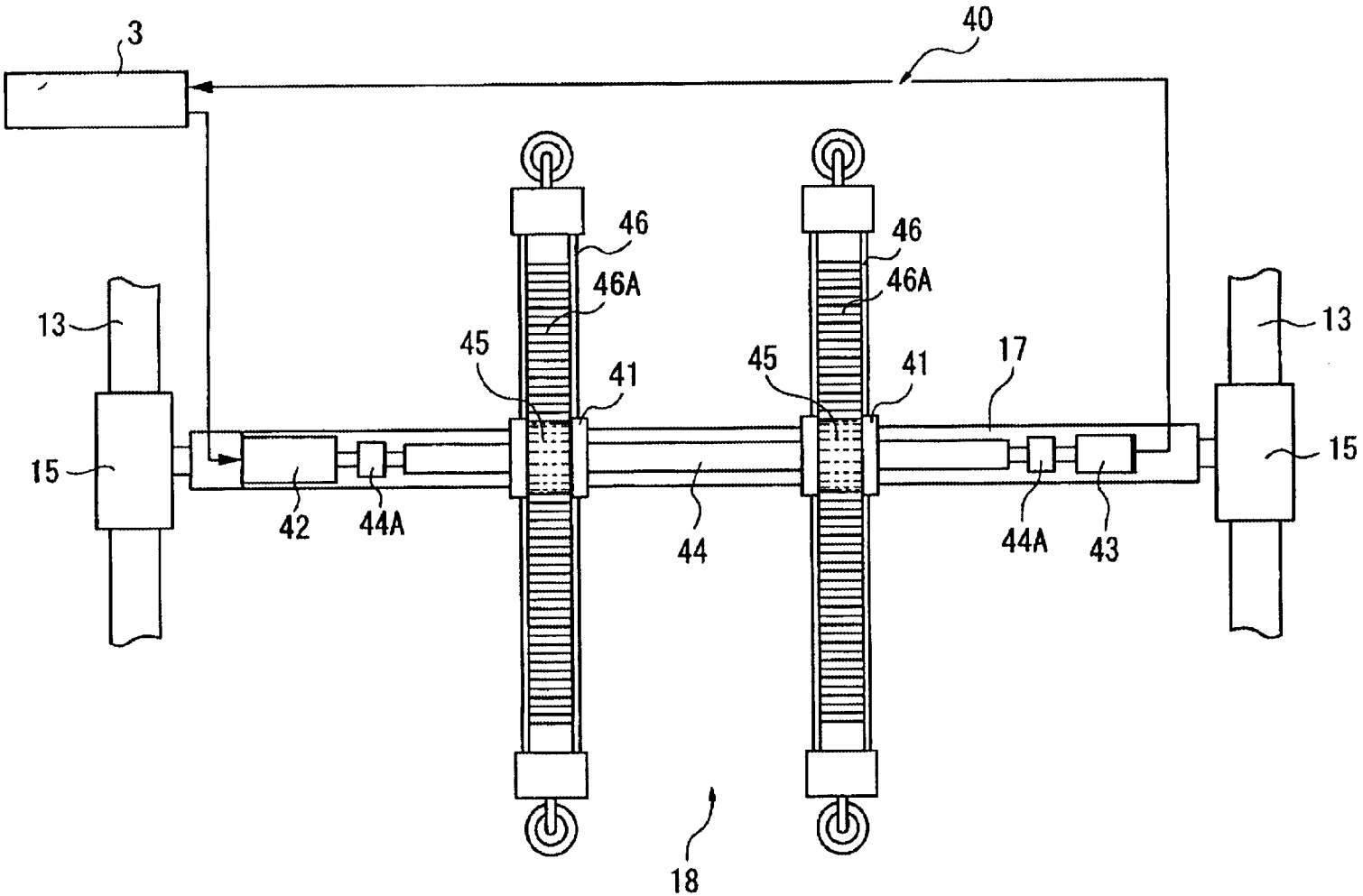
FIG. 10 is a plan view of the crossbar-type offset unit according to the third embodiment of the invention.
Figure 11:
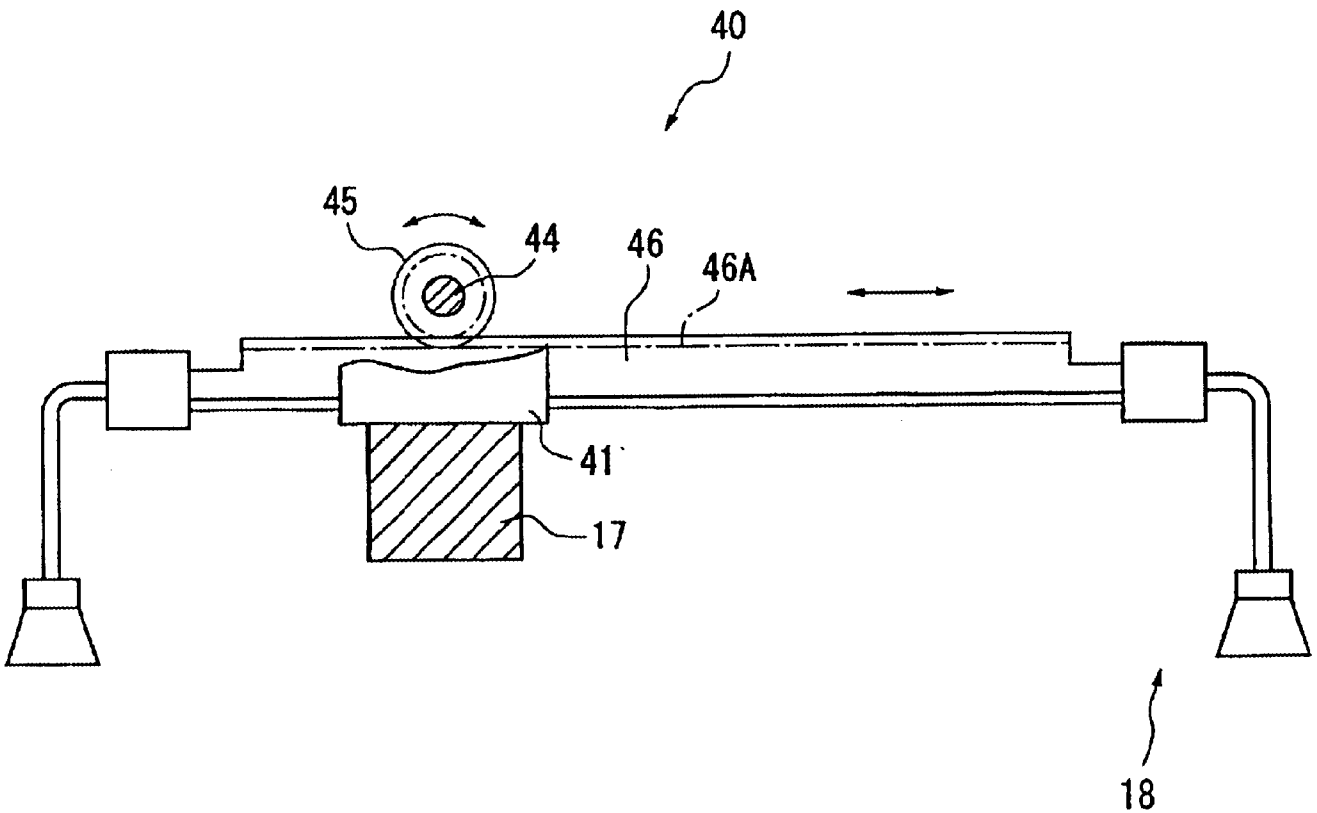
FIG. 11 is a side view showing the crossbar-type offset unit according to the third embodiment.

Another embodiment of the offset unit is shown in FIG. 10 and FIG. 11.

This unit is a crossbar-type offset unit 40 provided on the crossbar 17, comprising a pair of guide members 41 secured on the crossbar 17 at a distance along the longitudinal direction, a motor 42 provided at one end of the crossbar 17, an encoder 43 provided at the other end of the crossbar 17, a shaft 44 connected to the motor 42 at one end via a coupling 44A and supported by the encoder 43 at the other end via the coupling 44A and rotatably supported by the guide member 41, a pinion 45 provided corresponding to each guide member 41 and rotated integrally with the shaft 44, and a movable bar 46 inserted between the pinion 45 and the guide member 41 and formed with rack 46A to be engaged with the pinion 45 on the upper surface thereof, wherein the movable bar 46 is provided with vacuum cup units 18 mounted at both ends in the longitudinal direction (in the workpiece conveying direction) separately.

In such a crossbar-type offset unit 40, the pinion 45 is rotated by the motor 42 on the crossbar 17 during travel of the carrier 15, and the movable bar 46 engaged with the pinion 45 is moved toward the upstream side or the downstream side as seen in the workpiece conveying direction.

Accordingly, the vacuum cup units 18 mounted at both ends of the movable bar 46 are moved and offset to the center of the workstation W1–W4, and thus the workpiece 11 can be reliably attached and detached to be transferred, thereby obtaining the same effects as in (16) described above.

The offset amount in this case can be controlled by the controller 3 which controls the number of revolutions of the motor 42 based on the output from the encoder 43.

According to the crossbar-type offset unit 40, the following effects can be expected in addition to the effects stated in (1) to (16).

(17) One each of motor 42 and encoder 43 are constructed by providing the crossbar-type offset unit 40 on the crossbar 17, which result in reduction of the cost. By employing one motor 24, the error in the offset amount may hardly be generated between the pair of movable bars 46, even when an error is generated, no twisting power is exerted on the crossbar 17 so that the workpiece 11 can be desirably transferred.

Other Embodiments

The invention is not limited to the embodiments described above, but includes other constructions that can achieve the object of the invention, and thus the following modifications are included in the invention.

Figure 12:
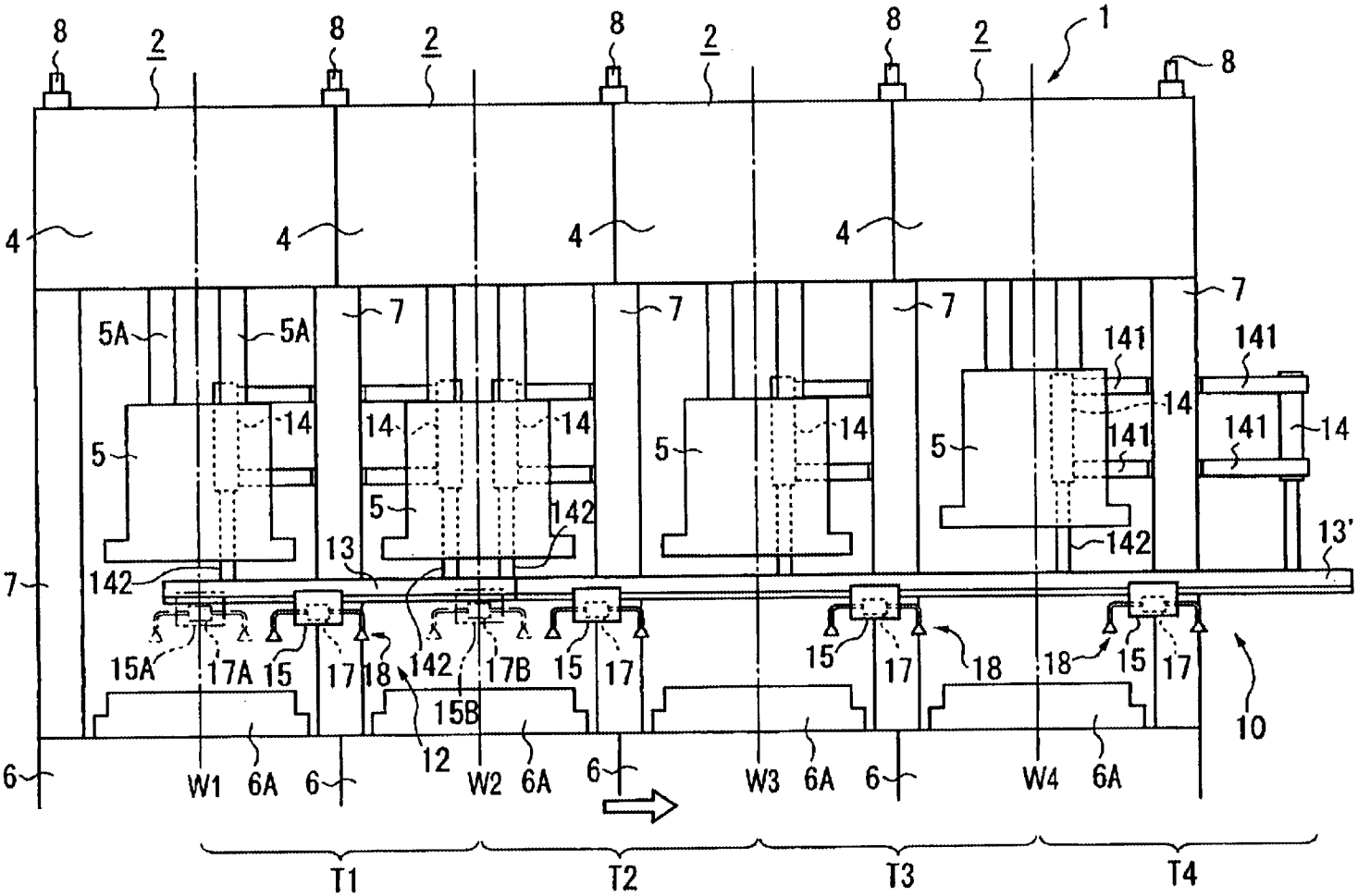
FIG. 12 is a front view showing an alternative example of the invention.
Figure 13:
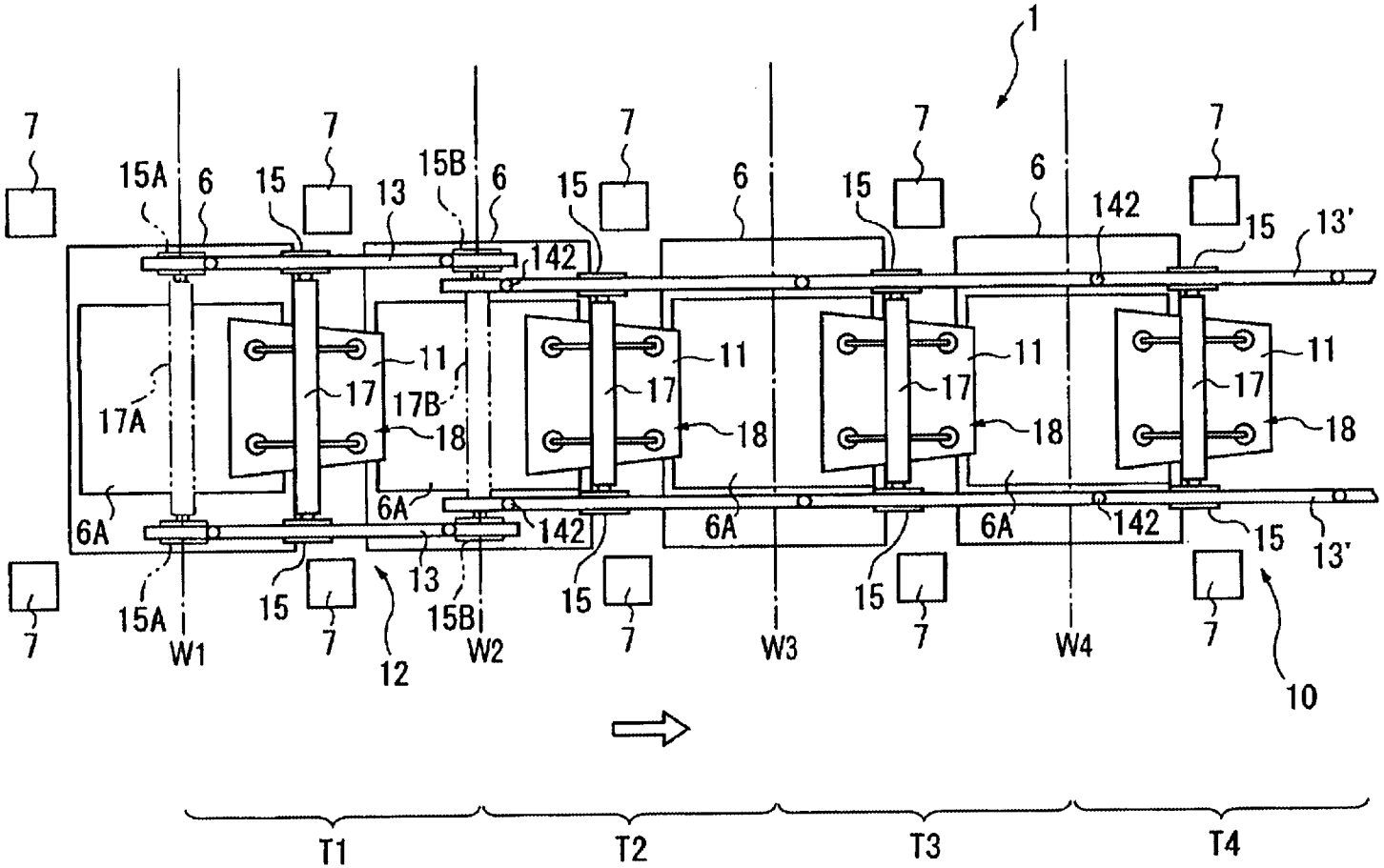
FIG. 13 is a plan view showing the alternative example.

For example, though a pair of lift beams 13 are provided for each transfer area T1–T4 in the transfer feeder 10 according to the first and the second embodiments, according to the transfer feeder of the invention, any number of the pairs of the lift beams is acceptable irrespective of the number of the transfer areas as far as there are at least two pairs, one on the upstream side and one on the downstream side. Therefore, though a pair of lift beams 13 is provided in the transfer area T1 as shown in FIG. 12 and FIG. 13 for example, a continuous lift beam extending across a plurality of transfer areas may be used, that is, a pair of continuous lift beams 13' may be provided through the transfer areas T2–T4.

However, in such a case as well, a pair of carriers 15 for moving the vacuum cup units 18 and a crossbar 17 laid therebetween are preferably provided in each transfer area T1–T4 in order to transfer the workpiece 11.

The operating modes of the transfer press 1 and the transfer feeder 10 include the following mode in addition to the operating modes A to E described in conjunction with the embodiments described above.

That is the mode in which each of them is operated in a "multi-drive mode". For example, in the workstations W1, W2 and the transfer areas T1, T2, the slide 5, the lift beams 13 and the carriers 15 are operated in the "simultaneous drive mode under the different conditions", and accordingly, the units 2 and 12 are operated as a tandem press line. While in the workstation W3 and the transfer area T3, all the members are halted for using them for stacking the workpieces 11. Further, in the workstation W4 and the transfer area T4, the slide 5, the lift beams 13, and the carriers 15 are driven in the "independent drive mode" for using it as an independent press.

As a matter of course, it is also possible to operate the workstations W1, W2 and the transfer areas T1, T2 in the "simultaneous drive mode without phase difference". After all, which drive mode the workstations W1–W4 and the transfer areas T1–T4 employ is arbitrary.

All the slides 5 are driven when operating transfer process in Operating Mode A in the first embodiment. However, in the case where the workstation W3 is used as an idling workstation, even for performing the transfer process in the same manner, the slides 5 in the remaining workstations W1, W2, and W4 are driven in the "simultaneous drive mode without phase difference", and the slide 5 in the workstation W3 is halted. Then the lift beams 13 and the carriers 15 in all the transfer areas T1–T4 must simply be driven in the "simultaneous drive mode without phase difference".

Though the vacuum cup units 18 are provided on the crossbar 17 in the first and the second embodiments, it is also possible to provide an arm projected toward the workpiece 11 on each carrier 15 so that the vacuum cup unit 18 may be mounted thereon.

In such a construction, the crossbar is not necessary, and thus a pair of carriers provided on each feed unit 12 move independently. However, since the vacuum cup unit 18 is cantilevered and thus the lift beam 13 is susceptible to fall on the side of the workpiece 11, any reinforcing structure is required for ensuring that the workpiece 11 is securely held and transferred.

Further, when the carrier 15 that moves independently is employed, a finger as workpiece holder is provided on the carrier 15 so as to move toward and away from the workpiece 11 freely, so that the workpiece 11 is placed on and transferred by the finger.

The servomotor 14 is not limited to the one that is disposed above the lift beam 13, and it may be disposed below the lift beam 13, which is also included in the scope of the invention.

The lift shaft driving mechanism is not limited to the servomotor 14, and it may be any means such as a servo cylinder or the like as far as it can automatically control the movement of the lift beam 13.

While the slide drive unit 20 including the main motor 21 for driving the slide 5 is provided for each workstation W1–W4 in the first and second embodiments, it is also possible to use the transfer feeder of the invention in the transfer press having a common main motor (drive source) for driving all the slides. Alternatively, the transfer feeder of the invention may be use in the transfer press in which a plurality of workstations are provided on one slide. The operating mode must simply be Operating Mode A or Operating Mode B in these cases, and thus the detailed description will not be made.

What is claimed is:

1. A transfer feeder (10) to be used for a transfer press (1) provided with a plurality of workstations (W1, W2, W3, W4) comprising:

a pair of parallel lift beams (13) disposed along the workpiece conveying direction;

another pair of lift beams (13) disposed adjacent to the pair of lift beams on the upstream side or the downstream side thereof so that adjacent portion is located substantially at a center of the workstation in the workpiece conveying direction;

lift driving mechanism (14) for moving the pair of lift beams and another pair of lift beams independently in the vertical direction;

a carrier (15) provided for each lift beam;

carrier driving mechanism provided with a linear motor (16) for moving the carrier along the length of the lift beam;

workpiece holder (18) disposed between the pair of carriers opposed with each other in the direction orthogonal to the workpiece conveying direction and being capable of holding the workpiece and moving along with the pair of carriers; and controller (3) for driving the pair of lift beams and of the carriers between the workstations respectively simultaneously and/or independently by controlling the lift driving mechanism and the carrier driving mechanism;

wherein each pair of said lift beams moves only in a vertical direction.

2. A transfer feeder (10) to be used for a transfer press (1) provided with a plurality of workstations (W1, W2, W3, W4) and slide drive units (20) at each of the workstations comprising:

a pair of parallel lift beams (13) disposed along the workpiece conveying direction;

another pair of lift beams (13) disposed adjacent to the pair of lift beams on the upstream side or the downstream side thereof so that an adjacent portion is located substantially at a center of the workstation in the workpiece conveying direction;

lift driving mechanism (14) for moving the pair of lift beams and another pair of lift beams independently in the vertical direction;

a carrier (15) provided for each lift beam;

carrier driving mechanism provided with a linear motor (16) for moving the carrier along the length of the lift beam;

workpiece holder (18) disposed between the pair of carriers opposed with each other in the direction orthogonal to the workpiece conveying direction and being capable of holding the workpiece and moving along with the pair of carriers; and controller (3) for driving the pair of lift beams and of the carriers between the workstations respectively simultaneously and/or independently by controlling the lift driving mechanism, the carrier driving mechanism and slide drive units;

wherein each pair of said lift beams moves only in a vertical direction.

3. A transfer feeder according to claim 1, characterized in that the adjacent portions between the pair of lift beams and another pair of lift beams are provided at each workstation of the transfer press.

4. A transfer feeder according to claim 2, characterized in that the adjacent portions between the pair of lift beams and another pair of lift beams are provided at each workstation of the transfer press.

5. A transfer feeder according to claim 1, characterized in that the end portions of the pair of lift beams and the end portions of another pair of lift beams face toward each other in the workpiece conveying direction at the adjacent portions between the pair of lift beams and another pair of lift beams.

6. A transfer feeder according to claim 2, characterized in that the end portions of the pair of lift beams and the end portions of another pair of lift beams face toward each other in the workpiece conveying direction at the adjacent portions between the pair of lift beams and another pair of lift beams.

7. A transfer feeder according to claim 3, characterized in that the end portions of the pair of lift beams and the end portions of another pair of lift beams face toward each other in the workpiece conveying direction at the adjacent portions between the pair of lift beams and another pair of lift beams.

8. A transfer feeder according to claim 4, characterized in that the end portions of the pair of lift beams and the end portions of another pair of lift beams face toward each other in the workpiece conveying direction at the adjacent portions between the pair of lift beams and another pair of lift beams.

9. A transfer feeder according to claim 1, characterized in that the end portions of the pair of lift beams and the end portions of another pair of lift beams face toward each other in the direction orthogonal to the workpiece conveying direction in plan view at the adjacent portions between the pair of lift beams and another pair of lift beams.

10. A transfer feeder according to claim 2, characterized in that the end portions of the pair of lift beams and the end portions of another pair of lift beams face toward each other in the direction orthogonal to the workpiece conveying direction in plan view at the adjacent portions between the pair of lift beams and another pair of lift beams.

11. A transfer feeder according to claim 3, characterized in that the end portions of the pair of lift beams and the end portions of another pair of lift beams face toward each other in the direction orthogonal to the workpiece conveying direction in plan view at the adjacent portions between the pair of lift beams and another pair of lift beams.

12. A transfer feeder according to claim 4, characterized in that the end portions of the pair of lift beams and the end portions of another pair of lift beams face toward each other in the direction orthogonal to the workpiece conveying direction in plan view at the adjacent portions between the pair of lift beams and another pair of lift beams.

13. A transfer feeder according to claim 1, characterized in that the carrier is provided with a carrier-type offset unit (30) for moving the workpiece holder in the workpiece conveying direction.

14. A transfer feeder according to claim 2, characterized in that the carrier is provided with a carrier-type offset unit (30) for moving the workpiece holder in the workpiece conveying direction.

15. A transfer feeder according to claim 7, characterized in that the carrier is provided with a carrier-type offset unit (30) for moving the workpiece holder in the workpiece conveying direction.

16. A transfer feeder according to claim 8, characterized in that the carrier is provided with a carrier-type offset unit (30) for moving the workpiece holder in the workpiece conveying direction.

17. A transfer feeder according to claim 11, characterized in that the carrier is provided with a carrier-type offset unit (30) for moving the workpiece holder in the workpiece conveying direction.

18. A transfer feeder according to claim 12, characterized in that the carrier is provided with a carrier-type offset unit (30) for moving the workpiece holder in the workpiece conveying direction.

19. A transfer feeder according to claim 1, characterized in that the workpiece holder is attached on a crossbar (17) which is laid between the carriers facing toward each other with the workstation interposed therebetween, and the crossbar is provided with a crossbar-type offset unit (40) for moving the workpiece holder in the workpiece conveying direction.

20. A transfer feeder according to claim 2, characterized in that the workpiece holder is attached on a crossbar (17) which is laid between the carriers facing toward each other with the workstation interposed therebetween, and the crossbar is provided with a crossbar-type offset unit (40) for moving the workpiece holder in the workpiece conveying direction.

21. A transfer feeder according to claim 7, characterized in that the workpiece holder is attached on a crossbar (17) which is laid between the carriers facing toward each other with the workstation interposed therebetween, and the crossbar is provided with a crossbar-type offset unit (40) for moving the workpiece holder in the workpiece conveying direction.

22. A transfer feeder according to claim 8, characterized in that the workpiece holder is attached on a crossbar (17) which is laid between the carriers facing toward each other with the workstation interposed therebetween, and the crossbar is provided with a crossbar-type offset unit (40) for moving the workpiece holder in the workpiece conveying direction.

23. A transfer feeder according to claim 11, characterized in that the workpiece holder is attached on a crossbar (17) which is laid between the carriers facing toward each other with the workstation interposed therebetween, and the crossbar is provided with a crossbar-type offset unit (40) for moving the workpiece holder in the workpiece conveying direction.

24. A transfer feeder according to claim 12, characterized in that the workpiece holder is attached on a crossbar (17) which is laid between the carriers facing toward each other with the workstation interposed therebetween, and the crossbar is provided with a crossbar-type offset unit (40) for moving the workpiece holder in the workpiece conveying direction.

* * * * *